US011553801B2

(12) United States Patent
Saleeby, Jr.

(10) Patent No.: US 11,553,801 B2
(45) Date of Patent: Jan. 17, 2023

(54) BED DIVIDER

(71) Applicant: Raymond Saleeby, Jr., St. Louis, MO (US)

(72) Inventor: Raymond Saleeby, Jr., St. Louis, MO (US)

( * ) Notice: Subject to any disclaimer, the term of this patent is extended or adjusted under 35 U.S.C. 154(b) by 157 days.

(21) Appl. No.: 17/006,443

(22) Filed: Aug. 28, 2020

(65) Prior Publication Data

US 2022/0061558 A1 Mar. 3, 2022

(51) Int. Cl.
*A47C 21/00* (2006.01)
*A47G 9/10* (2006.01)

(52) U.S. Cl.
CPC ..... *A47C 21/00* (2013.01); *A47G 9/1009* (2013.01)

(58) Field of Classification Search
CPC ..... A61G 10/005; A47G 5/00; A47C 31/00; A47C 21/00
See application file for complete search history.

(56) References Cited

U.S. PATENT DOCUMENTS 130,355 A * 8/1872 Briggs ..... A47C 21/00 5/513
706,748 A * 8/1902 Fish ..... A47C 21/00 5/513
754,353 A * 3/1904 Smith ..... A47C 21/00 5/513
883,884 A * 4/1908 Hopkins ..... A47C 21/00 5/513
930,554 A * 8/1909 Moody ..... A47C 21/00 160/334
1,092,298 A * 4/1914 Schwarz ..... A47C 21/00 5/512
1,094,679 A * 4/1914 Roberti ..... A47C 21/00 5/513
1,432,383 A * 10/1922 Comings ..... A61G 7/0518 160/334
1,472,731 A * 10/1923 Marvin ..... A47C 21/00 24/72.5
1,669,573 A 5/1928 Pejka
1,875,522 A * 9/1932 Sweet ..... A47C 21/00 5/513

(Continued)

OTHER PUBLICATIONS

U.S. Pat. No. 0754353; Mar. 8, 1904; Entitled: Bed-Partition; John E. Smith and James P. Smith.

*Primary Examiner* — Eric J Kurilla
(74) *Attorney, Agent, or Firm* — Sandberg Phoenix & von Gontard PC

(57) ABSTRACT

A bed divider is disclosed that is positionable atop a mattress to extend between two partners in a co-sleeping arrangement. The bed divider includes a support column that acts a support post, two side arms removably securable to opposite sides of the support column, and a divider removably securable to a third side of the support column to extend generally perpendicularly from the side arms. The divider and the side arms can be composed, in part, of an antibacterial and hypoallergenic material, such that the transmission of infectious diseases may be reduced. The divider and the side arms are sized to fit into a pillowcase, thereby providing a protective layer that is removable and machine washable. The divider and side arms are detachable from the support column, such that each may fit easily into a storage bag.

11 Claims, 5 Drawing Sheets

(56) References Cited

U.S. PATENT DOCUMENTS 1,979,520 A * 11/1934 Mary ..... A47C 21/00 5/513
2,471,977 A 5/1949 Power
2,510,656 A * 6/1950 Randel ..... A47C 21/00 5/513
2,555,905 A 6/1951 Pierre
2,556,913 A 6/1951 Gilbert
3,248,742 A * 5/1966 John ..... A47C 21/00 5/59.1
3,913,656 A * 10/1975 Guyer ..... E04B 2/7429 160/351
3,927,481 A * 12/1975 Safranek ..... A47G 5/00 434/432
3,971,182 A * 7/1976 Donahue ..... A47G 5/00 52/239
4,016,919 A * 4/1977 Zmijewski ..... A47C 21/00 248/459
4,021,973 A * 5/1977 Hegg ..... A47G 5/00 248/225.11
4,121,645 A * 10/1978 Behr ..... A47G 5/00 16/365
4,373,570 A * 2/1983 Nussdorf ..... E04H 1/1272 160/DIG. 18
4,591,693 A * 5/1986 Pike ..... A47C 21/048 219/217
4,953,246 A * 9/1990 Matthews ..... A61G 7/00 5/8
5,193,603 A * 3/1993 Whisnant ..... G09F 15/0068 160/229.1
D360,775 S * 8/1995 Karkoska ..... D6/335
5,560,058 A 10/1996 Smith
6,263,529 B1 * 7/2001 Chadwick ..... A61G 7/0526 5/424
6,510,572 B2 1/2003 Horowitz
7,082,634 B1 8/2006 Hinds et al.
9,737,151 B1 8/2017 Orlando
D851,977 S 6/2019 Krause
D867,772 S 11/2019 Sakich et al.
2002/0144347 A1 * 10/2002 Horowitz ..... A47C 21/00 5/513
2008/0276371 A1 11/2008 Stowers
2011/0186241 A1 8/2011 Sewell et al.
2017/0208963 A1 * 7/2017 Eichelberger ..... A47C 19/022
2019/0069685 A1 * 3/2019 Riggs ..... A47C 21/003
2019/0274439 A1 * 9/2019 Krause ..... A47C 21/00
2021/0337977 A1 * 11/2021 Garduno ..... A47C 21/00

* cited by examiner

BED DIVIDER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

This application relates to the field of sleep support items and more specifically to bed dividers to reduce the transmission of germs or infectious diseases between individuals sharing a bed and to reduce noise (such as from snoring).

When a person is sick with an infectious disease, it is desirable for others to limit the amount of contact with this person so as not to contract the illness. In a sleeping arrangement where two individuals share a bed, limiting contact may be difficult due to proximity. Furthermore, breathing in such close proximity to sick individuals, as is typical in when sharing a bed, increases the likelihood that the infectious disease will be transmitted from one individual to the other. Additionally, noise, such as from a snoring sleeper, can interfere with a partner's sleep. The transmission of germs and the transmission of noise could be reduced by a divider which separates partners in a bed.

Many bed dividers have been proposed which place a removable physical barrier between bed sharing individuals. However, these designs have many drawbacks. Some of the dividers are large and cumbersome, making them difficult to wash or store when not in use. Others are composed of a hard material with hard edges, making them either intrusive or uncomfortable. Others are permanent fixtures. In each of these cases, the bed divider can become an inconvenience to the user.

In view of these considerations, a new design for bed dividers is needed that is easier to use with easy assembly/disassembly, easy to clean, sturdy yet comfortable, and naturally germ resistant.

SUMMARY

Briefly, a bed divider is disclosed which, when assembled, provides a physical barrier between bed mates and which rests atop a mattress of a bed near a head of the bed. The bed divider comprises a support column, a divider removably connectable to the support column, and at least one side arm removably connectable to the support column. The divider has opposed main side surfaces and opposed end surfaces, and is formed of a material such that at least the opposed main side surfaces are soft. The at least one side arm similarly has opposed main side surfaces and opposed end surfaces and is formed of a material such that at least the opposed main side surfaces are soft. Connectors are provided on the support column, the at least one side arm, and the divider for removably connecting the at least one side arm and the divider to the support column.

In accordance with an aspect of the bed divider, the at least one side arm comprises of a rigid core.

In accordance with an aspect of the bed divider, the divider comprises a rigid core.

In accordance with an aspect of the bed divider, the at least one side arm comprises two side arms which are removably connectable to opposite sides of the support column, such that in the assembled configuration, the two side arms create a backplane.

In accordance with an aspect of the bed divider, in the assembled configuration, the divider is attached to the support column, such that the divider extends generally perpendicularly to the backplane created by said side arms and support column, thereby creating a T-like configuration.

In accordance with an aspect of the bed divider, the at least one side arm has a sloping end portion defined by a surface sloping inwardly from an end of the at least one side arm to a generally planar front surface of the at least one side arm. This end portion can provide additional support to pillows while containing pillows within a predefined space.

In accordance with an aspect of the bed divider the side arms and the divider are sized to be fitted into a removable outer cover sized to match the size of a pillowcase for a full sized, queen sized, or king sized pillow. Preferably, the outer cover is a pillowcase.

In accordance with an aspect of the bed divider, the cover is composed of an antimicrobial and/or hypoallergenic material.

In accordance with an aspect of the bed divider, the bed divider can be disassembled into separate components.

In accordance with an aspect of the bed divider, the bed divider includes a storage bag which will accommodate all the components of the bed divider.

BRIEF DESCRIPTION OF THE DRAWINGS

Additional details of the bed divider will be described herein with reference to the drawings and detailed description in the following sections.

Corresponding reference numerals will be used throughout the several figures of the drawings.

DETAILED DESCRIPTION

Figure 1:
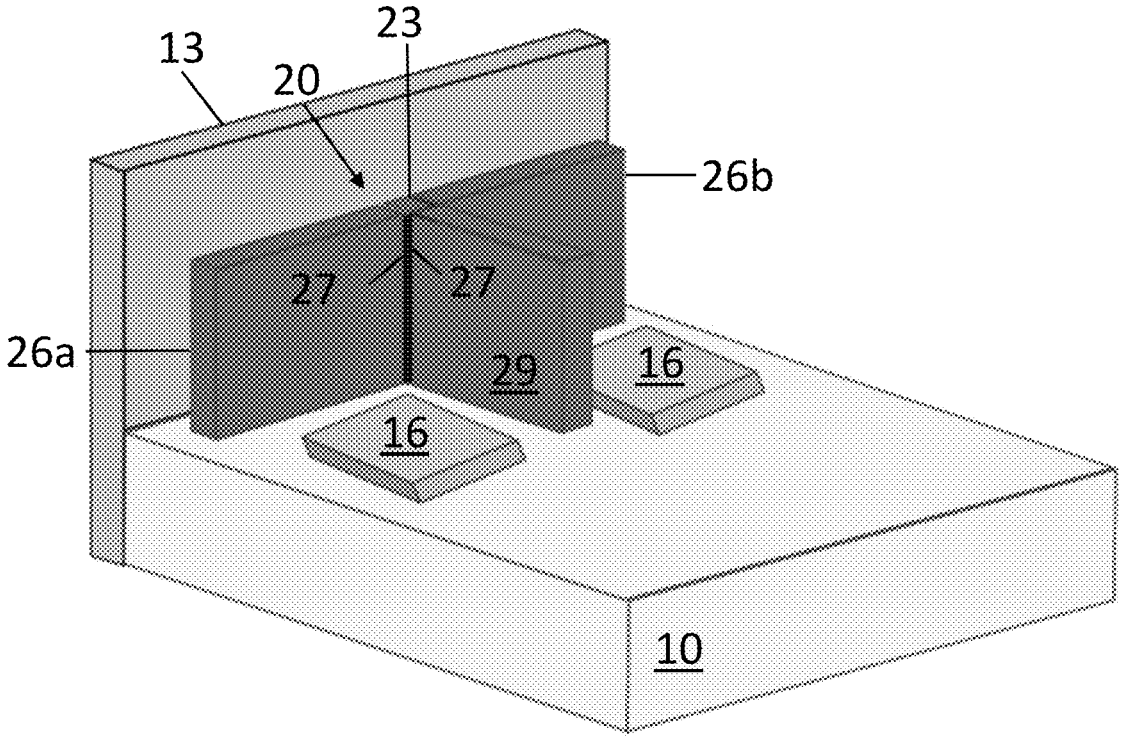
FIG. 1 is a perspective view of a bed divider on a bed in an assembled configuration.
Figure 2:
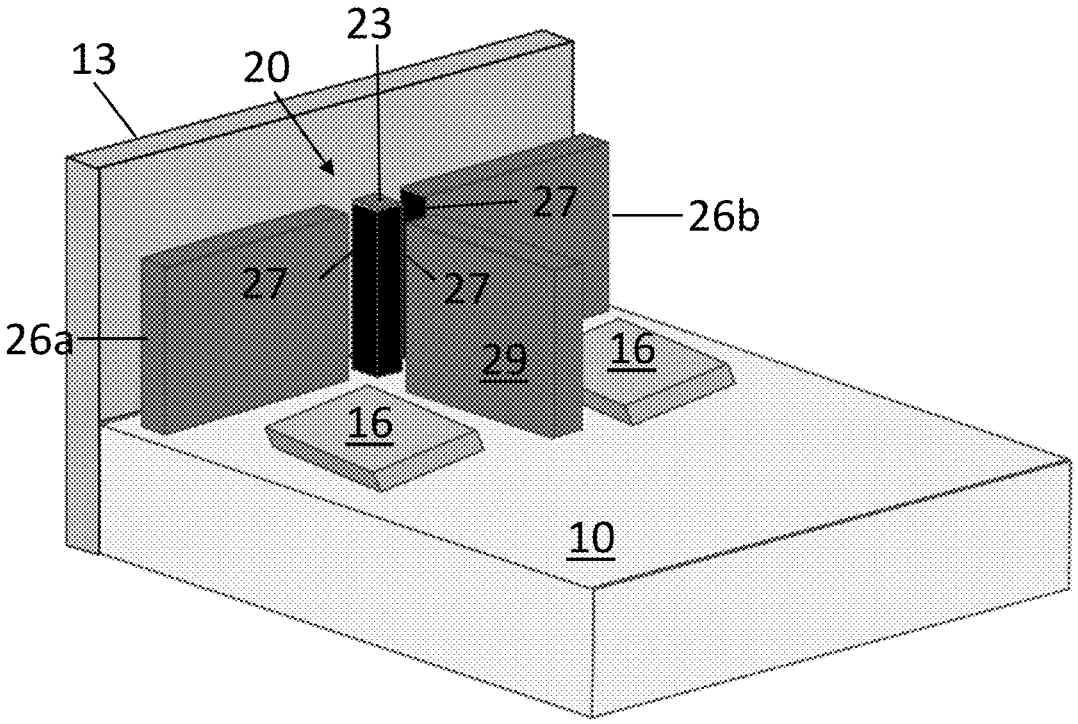
FIG. 2 is an exploded perspective view of the bed divider on a bed.

The following detailed description illustrates the claimed invention by way of example and not by way of limitation. This description will clearly enable one skilled in the art to make and use the claimed invention, and describe I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A bed divider 20, as shown in FIG. 1, can separate two people in a bed, for example, when one is sick, so as to help reduce the transmission of germs. The bed divider 20 comprises a main support column 23 which is placed against a wall or a headboard 13 of a bed 10, two side arms 26*a,b* which extend along the wall or headboard 13 (preferably to the edge of the bed 10), and a divider 29 which extends generally perpendicularly to the two side arms 26*a,b*. The support column 23, the side arms 26*a,b*, and the divider 29 have a height approximately equal to the depth of a standard pillow case, for example, about 20 inches, such that, the bed divider 20, when in use, extends vertically from the top surface of the mattress to a height approximately equal across all main components.

The bed divider 20, when in use, is generally positioned upon a mattress of a bed 10 proximate to the wall or headboard 13, such that the support column 23 is approximately centered on the mattress between opposite sides of the bed 10. The main support column 23 is generally rectangular cubic in shape, having generally square top and bottom surfaces and generally rectangular on side surfaces, all four sides having the same height dimensions.

Figure 3:
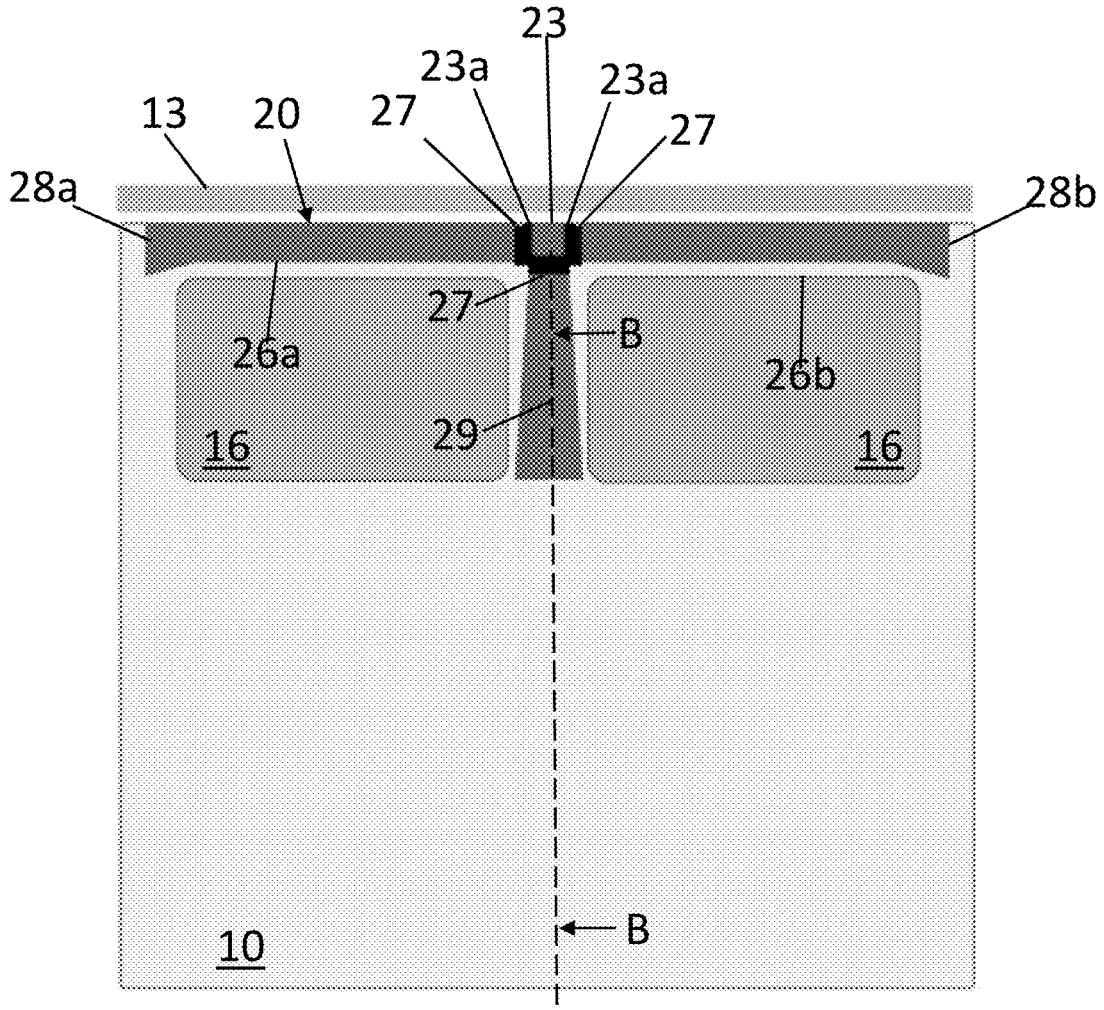
FIG. 3 is a top plan view of the bed divider on a bed in an assembled configuration.
Figure 4:
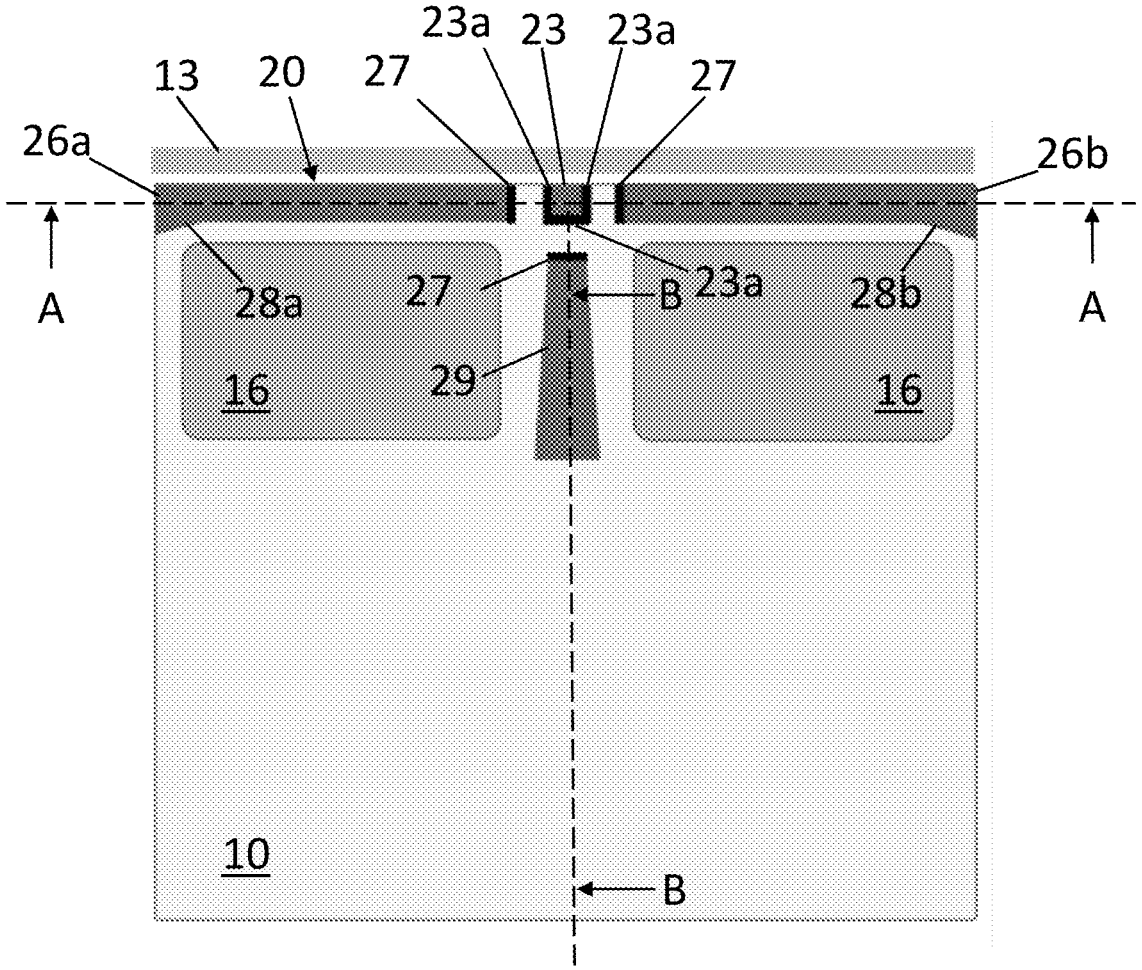
FIG. 4 is an exploded top plan view of the bed divider on a bed.

The side arms 26*a,b* extend from the support column 23 generally parallel to the wall or headboard 13 a length at least approximately equal to the width of a pillow. It should be noted that the width of a pillow based on the type of bed it is intended for. For example, a standard pillow is about 26 inches wide, a queen pillow is about 30 inches wide, and a king pillow is about 36 inches wide. As seen in FIG. 3, the arms 26*a,b* can extend beyond the ends of the pillows 16. The side arms 26*a,b* may be generally rectangular cubic in shape (i.e., with the faces of the side arms all being generally rectangular). However, the side arms may define a taper such that the front-to-back width of the side arms is narrower, for example, adjacent to the main support column 23 than at a free end of the side arms. Each of the side arms 26*a,b* is sized to fit into a standard sized pillowcase, and thus have a height and a length generally equal to the length and depth of a standard pillow case.

The side arms 26*a,b* can have tapered end portions 28*a,b*, as shown in FIG. 3 The end portions 28*a,b* extend between the top and bottom surfaces of the side arms and may slope inwardly from the outer edge of the side arms to the generally flat front surface of the side arms at a predetermined point between the top and bottom surface of the side arms. Preferably, the end portion defines only a small portion of the overall length of the side arms. As such, the end portions 28*a,b* reduce the potential for the pillow to move along the width of the bed, and thus provides for pillow support and pillow containment when an individual is asleep at night. If desired, the end portions could be formed as end caps which are removably mounted at the ends of the side arms.

The divider 29 extends generally perpendicularly from the support column 23 and the arms 26*a,b* away from the headboard 13 towards the foot of the bed along a line B-B. The divider has a length approximately the depth of a standard pillow from the support column 23. As such, the divider 29 is sized to fit into a standard sized pillowcase.

The divider 29 may be generally rectangular cubic in shape, but may have a taper (as shown exaggerated in FIG. 3) between the opposite ends, such that it is thinner (from side to side) adjacent the support column than at the end of the divider. By having a tapered divider (and tapered side arms) the size (footprint) of the main support column 23 can be reduced.

The side arms 26*a,b* and the divider 29 are removably secured to the support column 23 by means of connectors 27. The side arms 26*a,b* are attached to opposite faces of the main support column 23 via the connectors, thereby creating a backplane of the bed divider 20. The divider is then connected to the face of the main support column facing away from the wall via its connector. The connectors 27 can be any type of connector which will allow for easy and simple assembly and disassembly of the bed divider 20. In a preferred embodiment, the connectors 27 are all hook and loop connectors, such as mating pairs of Velcro® strips which are secured to respective faces of the main support column, the side arms, and the divider. Other types of connectors can be used as well. For example, the connectors can comprise snaps or hooked protrusions which are received in slots. As can be appreciated, such connectors enable the arms and divider to be connected to, and removed from, the support column without the use of tools.

Figure 5:
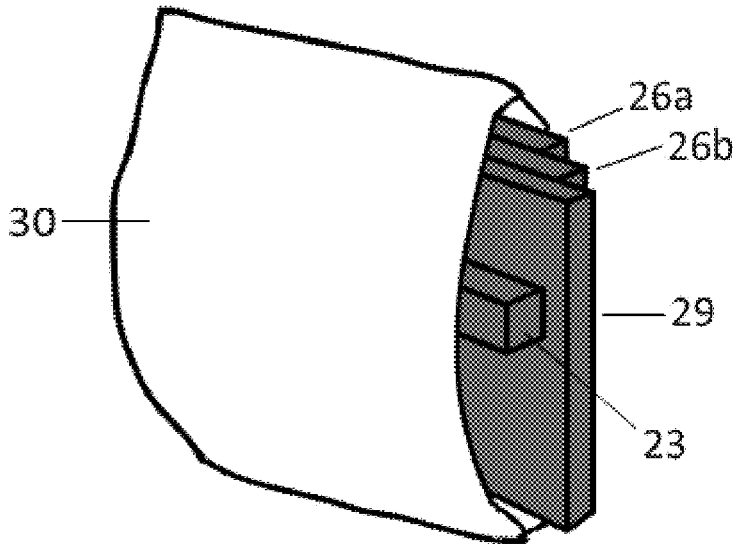
FIG. 5 is an isometric view of the storage bag shown containing components of the bed divider.

As can be appreciated from FIG. 3, the bed divider 20 generally forms a T-like configuration when fully assembled. As such, the bed divider 20 can also be disassembled into four separate components. As noted, the side arms 26 a,b and the divider 29 are all sized to be the generally same size as a standard pillow case. Thus, the components can be stored a storage bag 30 that can be sized according to sizes of pillow cases. Preferably, the storage bag 30 will be large enough to accommodate all four components of the bed divider 20, as can be appreciated from FIG. 5, and thus the dimensions of the storage case will be larger than the dimensions of a standard (full, queen, or king bed) pillow case. Due to the relatively small size, the disassembled bed divider can then be stored under the bed, for example. The small size of the components also allows for easier cleaning of the components.

The support column 23 is composed of a material sufficiently rigid to provide support to the arms and the divider. Similarly, the divider 29 is sufficiently rigid such that it can remain generally vertical along its length, when supported at only one end. The material may be a hard plastic or foam, but other rigid materials capable of providing support may be used. The side arms 26*a,b* and divider 29 have, at a minimum, a soft, compressible outer material, such as a foam, similar to a foam pillow. The foam material is preferably hypoallergenic, and can have, or be provided with, antimicrobial and/or antibacterial properties. The side arms 26*a,b* and divider 29 can also include a rigid core, if desired, for added support. Such a core could, for example, comprise a sheet of plastic. Such a core would only be necessary if the arms 26*a,b* and divider 29 were not otherwise sufficiently rigid to remain generally vertical when in use.

When in use, the arms 26*a,b* and divider 29 act as a barrier, reducing the transmission of germs, virus, or other infectious diseases between individuals sharing a bed. Because the side arms and divider are the size of a pillowcase, they can each be covered with a standard pillowcase. The pillowcases used to cover the side arms and divider can be washed between uses of the divider, reducing the ability for germs to infest the elements of the bed divider 20, and thus providing additional protection from the spread of germs. Additionally, the pillowcase may be composed of any material that is capable of trapping germs, infectious diseases, or microbes, thereby, further reducing transmission between sleeping individual.

In view of the above, it will be seen that a simple to use bed divider has been provided. The bed divider is not mounted to the wall, headboard, or any other part of the bed. The divider thus is simple to erect and to take down. Further, its small size allows for easy storage.

As various changes could be made in the above constructions without departing from the scope of the invention, it is intended that all matter contained in the above description or shown in the accompanying drawings shall be interpreted as illustrative and not in a limiting sense.

The invention claimed is:

1. A bed divider, comprising:

a support column;

a divider removably connectable to the support column; said divider having opposed main side surfaces and opposed end surfaces; said divider being formed of a material such that at least the opposed main side surfaces are soft;

at least one side arm removably connectable to the support column; said at least one side arm having opposed main side surfaces and opposed end surfaces; said at least one side arm being formed of a material such that at least the opposed main side surfaces are soft; and connectors on said support column, said at least one side arm, and said divider for removably connecting said at least one side arm and said divider to said support column, wherein said connectors comprise mating pairs of hook and loop material, snaps, or hooked protrusions received in slots which enable said arms and said divider to be connected to, and removed from, said support column without the use of tools;

wherein in an assembled configuration, said bed divider provides a physical barrier between pillows resting atop a mattress of a bed near a head of the bed.

2. The bed divider of claim 1, wherein said at least one side arm further comprises of a rigid core.

3. The bed divider of claim 1, wherein said divider further comprises a rigid core.

4. The bed divider of claim 1, wherein said at least one side arm comprises two side arms which are removably connectable to opposite sides of said support column, wherein, in the assembled configuration, said two side arms creating a backplane.

5. The bed divider of claim 4, wherein in the assembled configuration, said divider is attached to said support column, such that the divider extends generally perpendicularly to said backplane created by said side arms and support column, thereby creating a T-like configuration.

6. The bed divider of claim 1, wherein said side arms and said divider are sized to be fitted into a removable outer cover sized to match the size of a pillowcase; for a full sized, queen sized, or king sized pillow.

7. The bed divider of claim 6, wherein said outer cover is a pillowcase.

8. The bed divider of claim 6, wherein said cover is composed of an antimicrobial and/or hypoallergenic material.

9. The bed divider of claim 1, wherein said bed divider can be disassembled into separate components.

10. The bed divider of claim 9, including a storage bag sized to accommodate said separate components.

11. A bed divider, comprising:

a support column;

a divider removably connectable to the support column; said divider having opposed main side surfaces and opposed end surfaces; said divider being formed of a material such that at least the opposed main side surfaces are soft;

at least one side arm removably connectable to the support column; said at least one side arm having opposed main side surfaces and opposed end surfaces; said at least one side arm being formed of a material such that at least the opposed main side surfaces are soft; wherein said at least one side arm has a sloping end portion defined by a surface sloping inwardly from an end of said at least one side arm to a generally planar front surface of said at least one side arm, whereby said end portion provides additional support to pillows while containing pillows within a predefined space; and connectors on said support column, said at least one side arm, and said divider for removably connecting said at least one side arm and said divider to said support column;

wherein in an assembled configuration, said bed divider provides a physical barrier between pillows resting atop a mattress of a bed near a head of the bed.

* * * * *